United States Patent [19]

Brouwer

[11] 4,407,334

[45] Oct. 4, 1983

[54] METHOD AND APPARATUS FOR POSITIVELY REMOVING WEFT FROM AIR INSERTION GUIDANCE TUBE

[75] Inventor: Charles W. Brouwer, East Greenwich, R.I.

[73] Assignee: Leesona Corporation, Warwick, R.I.

[21] Appl. No.: 64,021

[22] Filed: Aug. 6, 1979

[51] Int. Cl.[3] ..... D03D 47/30

[52] U.S. Cl. ..... 139/435; 139/194

[58] Field of Search ..... 139/188, 190, 429, 435, 139/450, 194

[56] References Cited

U.S. PATENT DOCUMENTS 1,833,279 11/1931 Davis ..... 139/188

4,127,149 11/1978 Kikachi et al. ..... 139/435

*Primary Examiner*—Henry Jaudon

*Attorney, Agent, or Firm*—Burnett W. Norton

[57] ABSTRACT

In a method and apparatus for weaving in which a weft strand is projected in substantially free flight into the warp shed of a loom and is guided across at least a portion of the shed by a plurality of guides, preferably annular in shapes disposed in operative position within the shed in interdigitating with the warp threads, the guides being moved to and fro along an arcuate path for withdrawal to an inoperative position substantially entirely outside the shed and return within the shed and having an opening at a common point thereon to permit the inserted strand to egress therefrom during their withdrawal from the shed, the improvement of (a) engaging the inserted weft strand at spaced points along its length while the strand is within the shed and within the guides and (b) bodily displacing the strand outwardly through such common opening before the guides are withdrawn from said shed. The strand is ordinarily displaced in timed relation to the movement of the guides along their path.

9 Claims, 2 Drawing Figures

METHOD AND APPARATUS FOR POSITIVELY REMOVING WEFT FROM AIR INSERTION GUIDANCE TUBE

FIELD OF THE INVENTION

This invention relates to a loom weaving system in which the weft is inserted through the shed of the loom by means of a pulse-like jet of air or other pressurized gaseous medium (hereinafter referred to generally as an air weft insertion system) and is concerned more particularly with an air weft insertion system including an interrupted guidance tube disposed in operative position within the shed and extending at least a portion of its length in order to assist the free flight of the weft therethrough, the interrupted guidance tube being constituted by an axially aligned array of thin guiding elements, preferably annular in configuration, arranged for interdigitating relation with the warp threads and movable from operative position within the shed to an inoperative position substantially entirely outside of the shed, the guidance tube elements having a common opening thereon to permit the inserted weft thread to egress therefrom and remain within the shed while such elements are being withdrawn outside the shed.

BACKGROUND OF THE INVENTION AND PRIOR PRACTICE

It is known in the weaving art to project a weft strand through the shed of a loom by means of a nozzle situated adjacent one side of the shed and capable of emitting into the shed a stream or jet of pressurized gas, typically air, for entraining the strand therein, the strand preferably being delivered for this purpose directly into the base of the nozzle. It is also known to associate with such a nozzle a weft guidance tube made up of an elongated array of closely spaced elements or segments having their lower ends mounted on the lay and defining with their free ends an interrupted or "porous" internal channel-like passageway extending through the shed to receive the air-projected strand. The elements as well as the passageway itself can take various shapes but a preferred shape for the free end is annular to give a generally tubular passageway. The free end of each element is provided with a slot-like opening from the internal passageway situated at a common peripheral point on all the elements through which the inserted strand can escape laterally from the passageway.

In prior art air insertion systems of this type, the array of segments or elements constituting the interrupted guidance tube are mounted in fixed position on the lay of the loom forwardly of the reed in such a location that as the lay swings forwardly to impact the reed against the fell of the fabric, the guidance tube elements are carried bodily below and outside of the shed to an inoperative position clear of the fell of the fabric which does not interfere with the beat up action of the reed. The inserted weft thread is naturally restrained from leaving the shed as the guidance tube is withdrawn to inoperative position outside the shed, due to the fact that the inserted weft extends across a multiplicity of warp strands and is prevented thereby from further lateral movement therebeyond. The slot-like opening in the guidance tube element permits the inserted weft to escape from the interior of the passageway formed by the elements as the latter drop below the floor of the shed, and to remain within the shed despite the withdrawal of the guidance tube therefrom.

Thus, the removal of the inserted weft from the guidance tube elements has up to now been a passive response of the inserted weft to the rocking motion of the lay, dependent upon the position of the guidance tube elements upon the lay, the effective arc of the lay and the initial orientation of the lay relative to some reference point, as to the point in the loom operating cycle at which the inserted weft egresses from the guidance tube elements. Since the lay is necessarily narrow in the warpwise direction, the possibility of warpwise adjustment of the position of the guidance tube array on the lay is insignificantly small, practically speaking, and the only way available to the prior art of adjusting the timing in the operative cycle of the egress of the inserted weft from the guidance tube is by changing the overall orientation angle of the lay, i.e., the angle of the lay supports at dead center. Such a change, however, requires a relocation of the lay pivot axis, an alteration in the length of the lay supports or both and neither can normally be accomplished without effecting a complete redesign of the loom in question. It would be desirable to provide greater flexibility in the air insertion system as to the timing of the removal of the inserted weft from the guidance tube array, as well as to achieve a direct or positive, rather than merely passive, withdrawal of the inserted weft from the guidance array in a positive fashion not dependent upon any blocking action of the warp threads which introduces the possibility of such threads becoming damaged.

SUMMARY OF THE INVENTION

In accordance with the present invention, the loom is equipped with means for positively engaging the inserted weft thread within the shed at spaced points along its length which means is adapted to be moved relative to the guidance tube array while the inserted weft is engaged thereby to bodily displace the inserted weft through the egress openings in the guidance tube array to a location within the shed outside the guidance tube independently of the rocking motion of the lay itself. In this way, the inserted weft can be entirely removed from the guidance tube array before the array itself has been withdrawn from the shed, and at any appropriate point in the operating cycle. Preferably the displacing means may take the form of an array of narrow fingers, considerably lesser in number than the array of guidance tube elements, which fingers are disposed to project between adjacent pairs of warp threads and adjacent pairs of elements. The fingers are mounted for rocking movement from an out-of-the-way position below the bore of the guidance tube to permit unhampered flight of the weft therethrough, to an upward position above and outside the guidance tube elements. The ends of the lift-out fingers can have a generally V-shaped configuration to engage the weft at the crotch of the V and retain the weft under control during the lift-out movement. The opposite ends of the fingers can be supported on a common rock shaft carried by the lay forwardly of the guidance tube array itself and rocked under the control of cam or other operating means carried on the frame of the loom.

STATEMENT OF OBJECTS

The object of the present invention is a method and means for engaging the weft strand while inserted in the shed within the guidance tube and for bodily removing the strand laterally from the guidance tube independently of the withdrawal of the guidance tube for the shed.

BRIEF DESCRIPTION OF DRAWINGS

These and other objects and advantages will be more fully explained by the following complete description when read in conjunction with the acompanying drawings in which.

GENERAL DESCRIPTION OF AIR WEFT INSERTION LOOM

Figure 1:
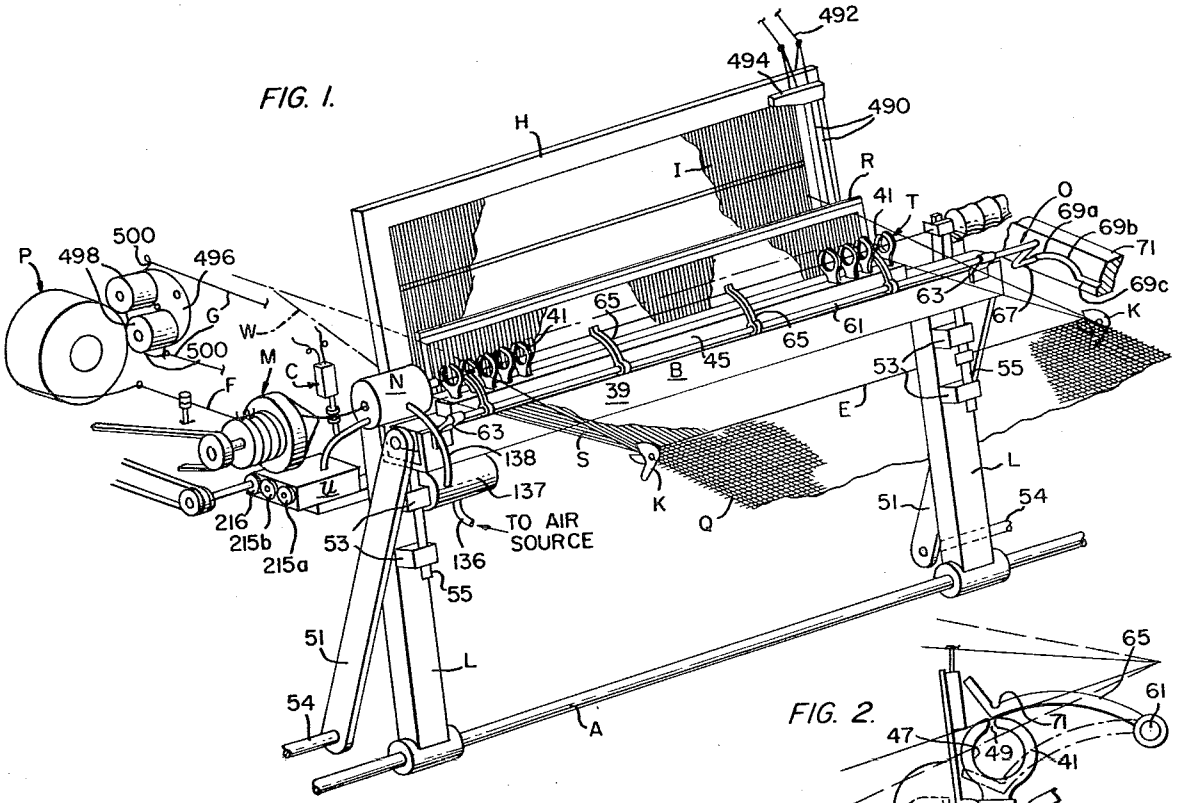
FIG. 1 is a highly schematic view in perspective of the essential components of a loom incorporating the present invention.

The present improvement can be employed with any known air weft insertion system which utilizes an interrupted guidance tube but preferaly is utilized with the overall system of this type which is described in U.S. application Ser. No. 64,180, filed Aug. 6, 1979, which issued on Sept. 7, 1982 as U.S. Pat. No. 4,347,872 and reference may be had to the complete disclosure found there for an understanding of the details of the various improvements which form part of this system. For present purposes, the loom is illustrated and described only in such general terms as needed to define the context for the invention. As usual, the warp threads or ends W are carried on a rotatably supported warp beam (not seen) and pass therefrom through the eyes of parallel arrays of heddle wires I held by corresponding heddle frames H. The heddle frames H reciprocate up and down and separate the warp threads to form an elongated diamond-shaped shed S having its front corner defined by the fell E of the fabric being woven. A lay beam B extends widthwise across the warp supported on generally upstanding supports or swords L pivoted on a shaft A and are rocked to and fro by driving means, such as a crankshaft, not shown. A reed R projects upwardly from the rear side of the lay to impress each new weft against the fell as the lay rocks forwardly. The woven fabric is collected in a conventional way upon a take-up beam, not shown.

The fabric has a fringe selvage Q which may be trimmed by means of trimming shears or knives K in operative position at the fell line and actuated in the usual way.

The lay B of the loom is equipped with an interrupted segmental weft guidance tube T to facilitate the delivery of weft or filling strands F through the shed, the guidance tube obtruding in interdigitating fashion with the warp ends into the interior of the shed when the lay is in its rearmost position and withdrawing from the shed while the lay moves forward. The tube T is formed by segments 41 arranged in closely spaced relation in a row on the lay, the segments preferably being annular with a generally circular interior aperture or bore 47. A slot-like opening 49 is cut through the segment periphery at a common point on all the segments to communicate with aperture 47. The weft is projected into the interrupted guidance tube by means of a burst or pulse of air emitted by a weft insertion nozzle N, while the free end of the inserted weft is received beyond the far side of the shed within a vacuum reception tube V. The generation of the pulse or burst of air through the nozzle is controlled by a nozzle activation control unit U which is actuated in timed relation to the cyclical operation of the loom. A proper length of weft is withdrawn from a weft package or other source P and made available to the insertion nozzle N by means of a strand metering and delivering unit M, and a clamping means C positively grips the weft F in timed relation to the inserting action.

DETAILED DESCRIPTION OF INVENTION

Figure 2:
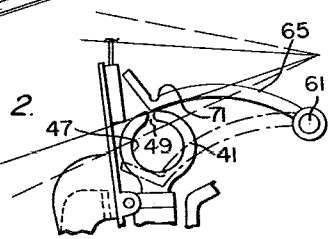
FIG. 2 is an enlarged detailed view of the upper portion of the lay in beat up position showing the weft lift-out device of the invention in projected position in solid lines and in retracted position for weft insertion in dotted lines.

According to the invention, a mechanism generally designated O in FIG. 1 is provided to lift out each inserted weft thread positively through egress slot 49 in the tube segment array. In this way, more direct control can be exercised over the position of the weft thread during beat up, and displacement of the weft out of the guidance tube can be effected at an earlier point in the beat up cycle of the lay than would otherwise be possible. To this end, as shown in FIGS. 1 and 2, a rock shaft 61 extends across the width of the loom on the forward side of the lay 39 at a location presenting a minimum of interference to access to the guidance tube from the front of the loom. The ends of rock shaft 61 are journalled for rotation in supports 63 projecting from the ends of lay 39, and several thin weft lift fingers 65 are affixed at one end to shaft 61 at appropriate intervals across the shed width including points adjacent the side edges of the shed. Since the relative mass of the weft is in any case extremely small, only that number of fingers 65 sufficient to keep the weft in a reasonably straight condition during the lifting action is needed (four being sufficient for a 40 inch loom, although more than four can, of course, be used), and lift fingers 65 can be quite thin so as to pass easily through the clearance spaces between the warp yarns of the shed. A bell crank lever 67 is fixed to one outside end of the rock shaft and the end of that lever acts as a cam follower which cooperates with a cam track 69 constructed in a stationary part 71 of the loom frame. The cam track 69 is appropriately curved to impart the desired motion to the lift fingers and includes in the schematically illustrated arrangement in FIG. 1, a rearward inverted flat U-shaped arcuate portion **69*a* connecting with a generally horizontal forward section 69*b*. Thus, during weft insertion at back dead center, fingers 65 are retracted below the bore 47 of tube T as shown in dotted lines in FIG. 3; and as the lay starts to move forwardly toward beat-up position, the cam follower immediately rides up in the cam track portion 69*a* to rock the fingers 65 quickly upward to the projected solid line position in FIG. 2, which lifts the weft vertically through the egress slot 49 in the tube segments 41, after which the follower drops to retract the fingers 65 and enters the horizontal track section 69*b* to hold the fingers 65** stably in their retracted position during beat up. When the lay returns to the weft insertion position, the fingers swing up and then down again to a retracted position below the bore of the guidance tube ready for the next weft to be inserted.

The shape of the fingers can vary, bearing in mind that the fingers must ultimately leave the shed between the warp threads in the same manner as the guidance tube segments and must be clear of the fell at beat up position. At the same time, the ends of the fingers making engagement with the thread should be contoured to positively catch and hold the thread during their lifting action to maintain good control over the thread. Preferaly, therefore, the rearward end of each lift finger terminates in a generally V-shaped notch 71 to define a crotch into which the thread will naturally fall as the fingers are lifted. The remainder of the fingers are arcuately curved to insure clearance with the shed threads as the lay pivots forwardly to beat up position. It is also preferred that the notch shaped rearward ends of the lift fingers lie in their retracted position somewhat past in the rearward direction of the center plane of the guidance tube; this locates the weft thread during its displacement from the tube bore 47 toward the rearward side of the guidance tube bore rather than the forward side and promotes smooth egress of the thread through exit slot 49.

By the action of the lifting mechanism just described, the weft thread is displaced essentially vertically relative to the arcuate path of the guidance tube during beat up, and consequently, the position of the exit slot should coincide substantially with the top point of the tube segment periphery. In this way, the removal of the weft is determined by the positive lifting action of the lifting mechanism independently of the motion of the guidance tube relative to the floor of the shed.

What is claimed is:

1. In the method of weaving in which a weft strand is projected in substantially free flight into the warp shed of a loom and is guided while in flight across at least a portion of the shed by a plurality of guides disposed in operative position within the shed in interdigitating relation with said warp threads, said guides being moved to and fro along an arcuate path to withdraw them between warp threads to an inoperative position substantially entirely outside the shed and then to return the same within the shed, said guides each having an opening at a common point to permit the projected strand to egress therefrom and remain within the shed during their withdrawal from the shed, the steps of (a) engaging the weft strand after said flight at spaced points along its length while the strand is within said shed and within said guides and (b) bodily displacing the strand laterally outwardly through said egress opening in said guides before said guides are withdrawn from said shed.

2. The method of claim 1 wherein said guides comprise an array of coaxial annular elements projecting between spaced apart pairs of adjacent warp threads and arranged in axially aligned relationship.

3. The method of claim 1 wherein said strand is displaced bodily in timed relation to the movement of the guides along their path.

4. In a loom having means for projecting a weft strand in substantially free flight into the warp shed thereof, means for guiding said flying strand within said shed across at least a portion of its length comprising a plurality of guides disposed in operative position within the shed in interdigitating relation with said warp threads, and means for moving said guides to and fro along an arcuate path to withdraw them between warp threads to an inoperative position substantially entirely outside the shed and then to return them within the shed, said guides each having an opening at a common point to permit the projected strand to egress therefrom and remain within the shed during their withdrawal from the shed, the improvement of (a) means for engaging the weft strand after said flight at spaced points along its length while the strand is within said guides and (b) means for moving said engaging means to bodily displace the strand laterally outwardly from said guides through said egress opening therein.

5. The loom of claim 4 wherein said guides comprise an array of coaxial annular elements projecting between spaced apart pairs of adjacent warp threads and arranged in axially aligned relationship.

6. The loom of claim 4 including means for operating the engaging means' moving means to displace said strand bodily in timed relation to the movement of the guides along their path.

7. The loom of claim 4 wherein said strand engaging means comprises an array of narrow fingers projecting through adjacent pairs of warp threads at spaced intervals across the shed and engaging the strand adjacent their ends, and the engaging means' moving means comprises a rockable support for said fingers and means for rocking said support.

8. The loom of claim 7 wherein said support rocking means comprises a cam follower associated with said support and a relatively movable cam surface for engaging said follower to rock said support.

9. The loom of claim 7 including a rockable lay and wherein said fingers and their support are carried by said lay.

* * * * *